United States Patent [19]

Schadler

[11] 4,141,787

[45] Feb. 27, 1979

[54] PROCESS FOR PREPARING CHEMICAL CELLULOSE ACCORDING TO THE SULFITE PROCESS BY INCREASING THE TOTAL $SO_2$ CONTENT OF COOKING ACID WITH LIQUID $SO_2$ AND DIGESTING WOOD CHIPS

[75] Inventor: Reinhold Schadler, Aschaffenburg, Fed. Rep. of Germany

[73] Assignee: PWA Papierwerke Waldhof-Aschaffenburg Aktiengesellschaft, Munich, Fed. Rep. of Germany

[21] Appl. No.: 613,907

[22] Filed: Sep. 16, 1975

[30] Foreign Application Priority Data

Sep. 24, 1974 [DE] Fed. Rep. of Germany ..... 2445523

[51] Int. Cl.[2] ..... D21C 1/06; D21C 3/06; D21C 3/08; D21C 3/10

[52] U.S. Cl. ..... 162/42; 162/43; 162/44; 162/50; 162/83; 162/84; 162/DIG. 2

[58] Field of Search ..... 162/83, 42, 36, 84, 162/DIG. 2, 43, 44, 50

[56] References Cited

U.S. PATENT DOCUMENTS

| | | | |
|---|---|---|---|
| 1,940,136 | 12/1933 | Haglund | 162/83 X |
| 2,192,239 | 3/1940 | Palmrose | 162/83 |
| 2,749,241 | 6/1956 | Marpillero | 162/83 |
| 2,859,108 | 11/1958 | Rosenblad | 162/83 |
| 3,046,182 | 7/1962 | Tomlinson et al. | 162/83 |
| 3,067,086 | 12/1962 | Wilson et al. | 162/83 |
| 3,262,839 | 7/1966 | Lüthgens | 162/83 |
| 3,383,277 | 5/1968 | Gordon et al. | 162/83 X |

FOREIGN PATENT DOCUMENTS 237583 2/1969 U.S.S.R.

OTHER PUBLICATIONS

Parfenova, "Increasing the Yield and Improving the Quality of Sulfite Pulp by Multistage Cooking" Bumazh, Prom, No. 7:11-12 (Jul. 1970), A.B.I.P.C. Abstract #5374, vol. 41, No. 6 (Dec. 1970).

Mencher, "Bisulfite Semichemical Pulp Optimization of the Stepwise Bisulfite/Sulfite Cooks" 12v. VUZ, Lesnoi Zh. 15, No. 4:121-126 (1972), A.B.I.P.C. Abstract #10632 vol.

Parfenova et al., USSR Pat. 403,795, 10-26-73, A.B.I.P.C. Abtract #11383, vol. 44, No. 10 (Apr. 1974).

*Primary Examiner*—S. Leon Bashore
*Assistant Examiner*—Steve Alvo
*Attorney, Agent, or Firm*—Burgess, Ryan and Wayne

[57] ABSTRACT

Chemical cellulose is produced by treatment in a digester. In the first step, wood in the form of chips is treated for a period of about from 15 to 90 minutes with a cooking acid of a calculated amount of below 5% by weight and at least 2.5% by weight of $SO_2$ and a mole ratio of $SO_2$ to MgO or CaO of from about 2 : 1 to 3.5 : 1 at a temperature of from about 45 to 90° C. The liquid $SO_2$ is fed into the digester until the total $SO_2$ content of the cooking acid is from about 6 to 10 percent by weight, and completing the digestion in a second step to obtain a pulp by cooking at a temperature of above 110° C., and working up the pulp in a manner known per se to obtain chemical cellulose.

19 Claims, 4 Drawing Figures

Inventive process using magnesium and liquid $SO_2$

Prior Art process using magnesium

Prior Art process using calcium

Inventive process using magnesium and liquid $SO_2$

Inventive process using calcium and liquid $SO_2$

PROCESS FOR PREPARING CHEMICAL CELLULOSE ACCORDING TO THE SULFITE PROCESS BY INCREASING THE TOTAL $SO_2$ CONTENT OF COOKING ACID WITH LIQUID $SO_2$ AND DIGESTING WOOD CHIPS

FIELD OF THE INVENTION

This invention relates to chemical cellulose making processes. More particularly the invention relates to a two step alkaline earth acid bisulfite process for making chemical cellulose often referred to as pulp.

BACKGROUND OF THE INVENTION

In a process for preparing chemical cellulose according to the sulfite process the debarked wood in form of chips is cooked with solutions of bisulfites (hydrogen sulfites) or sulfites, the so called cooking acid, also referred to as cooking liquor or cooking lye. Depending on whether the solutions of bisulfite contain additional sulfur dioxide or not the processes are designated as acid bisulfite processes (using excess of $SO_2$) or bisulfite processes (without excess $SO_2$).

As the basic component for the bisulfites, sodium or ammonium bases can be used in all processes. The use of calcium is restricted to the acid bisulfite process, and the use of magnesium is restricted to the acid bisulfite process and the bisulfite process because calcium and magnesium sulfite, respectively, precipitate at higher pH values.

The sulfite digestion is mainly carried out batchwise conducting the cooking in large, e.g. 225 $m^3$ digesters equipped with a circulating pump for circulation of the cooking acid. Heating is effected by heat exchangers in the circulating line or by directly introducing steam.

In the one step bisulfite process after having fed chips and (cold) cooking acid into the digester the chips are impregnated with the cooking acid. After increasing the temperature to about 110° C. the digester is maintained at said temperature from 2 to 4 hours, and then the temperature is increased to from 125° to 150° C.

Two or more step processes differ from the aforesaid process in that the real cooking step, i.e. the digestion which only takes place at a higher temperature (110° C. or above) is carried out in several steps having different pH values. Examples for such processes are a process in which the digestion is first conducted under acid and then under weak acid to basic conditions and a process in which the acidity is increased after a basic to neutral step.

Furthermore, a process is known in which the digestion is started with a neutral or weakly acid step (4% $SO_2$; 140° C.) essentially effecting the sulfonation, followed by an acid step (5% $SO_2$; 132° C.).

However, the known processes do not entirely fulfill practical requirements considering, in particular the length of time and consumption of chemicals required for at the digestion and the properties of the pulp and chemical cellulose obtained.

SUMMARY OF THE INVENTION

Accordingly, an object of the invention is to at least partly prevent the shortcomings described above.

The above mentioned object of the invention can be attained by a process in which the chips after the usual cold impregnation and before carrying out the real cooking are subjected to a treatment with a cooking acid of a relatively low acidity at a temperature of from about 45° to 90° C., followed by the real cooking at a temperature of above 110° C.

DETAILED DESCRIPTION

Figure 1:
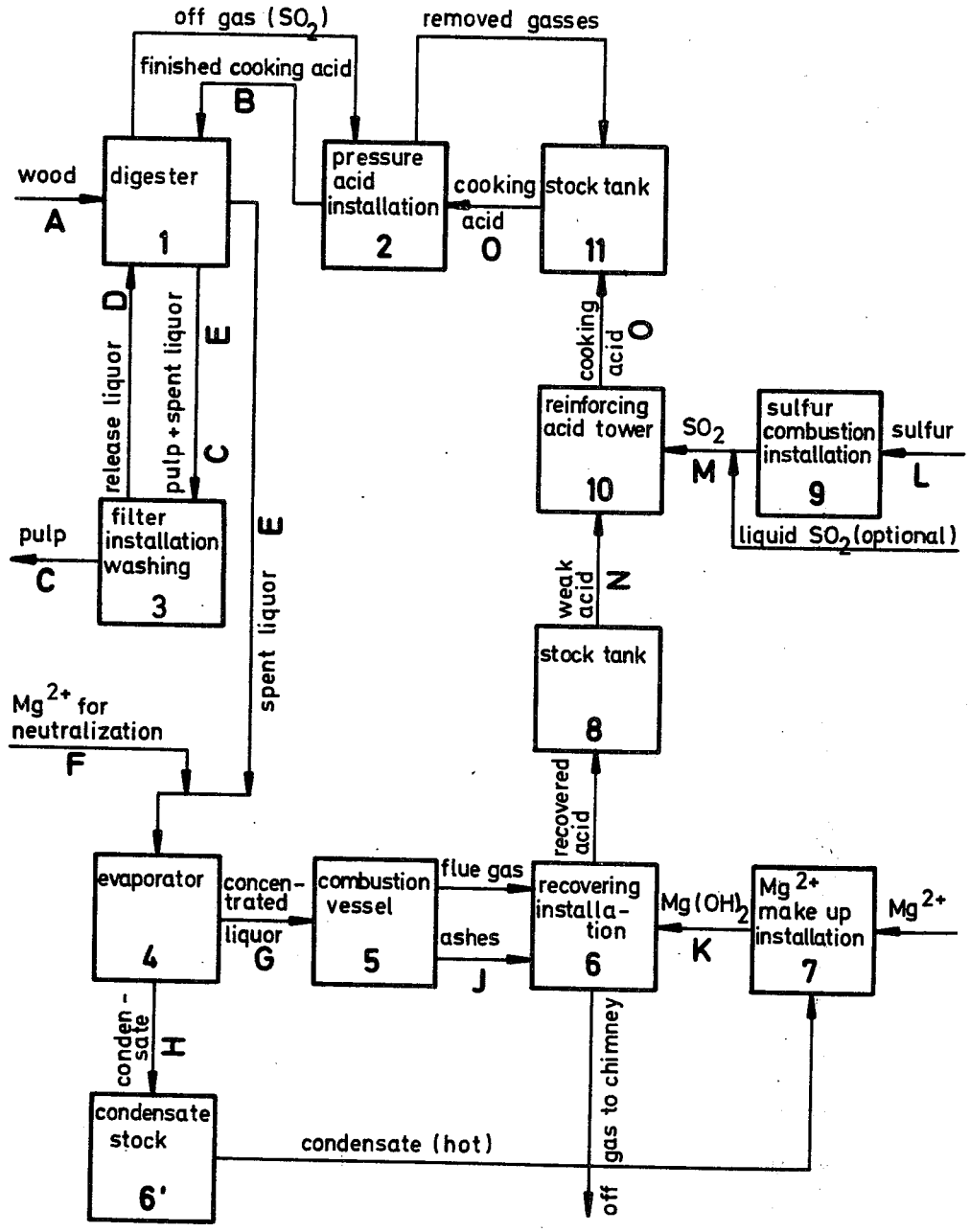
FIG. 1 is a schematic diagram illustrating the known process using magnesium as basic component.

In a preferred embodiment the process of the invention is carried out by treating in a first step wood in the form of chips for a time of from about 15 to 90 minutes with a cooking acid of a calculated concentration of below 5 percent by weight and at least 2.5 percent by weight of $SO_2$ and a mole ratio of $SO_2$ to MgO or CaO of from about 2:1 to 3.5:1 at a temperature of from about 45° to 90° C., then feeding liquid $SO_2$ until the total $SO_2$ content of the cooking acid is from about 6 to 10 percent by weight, and completing the digestion in a second step by cooking at a temperature of above 110° C., and working up the pulp in a manner known per se to obtain chemical cellulose.

The first step is carried out for a period of from about 15 to 90 minutes, preferably 30 to 60 minutes, at a temperature of from about 45° to 90° C., preferably 55° to 80° C., in particular 70° to 80° C. A temperature of about 75° C. is most preferred.

In the first step the total $SO_2$ content of the cooking acid is below 5 percent by weight, the upper limit existing at e.g. 4.9 or 4.8 percent by weight. The lower limit of the $SO_2$ concentration is 2.5 percent by weight, preferably 2.9 percent by weight. A concentration of about 4.0 percent by weight, e.g. from 3.8 to 4.2 percent by weight $SO_2$, is most preferred.

The term "total $SO_2$ content" relates to the total amount of $SO_2$ calculated, disregarding the fact whether the $SO_2$ is contained in chemically bound form or not.

In the first step magnesium oxide (MgO) or calcium oxide (CaO) is present in such a (calculated) amount that the mole ratio of total $SO_2$ to MgO or CaO is from about 2:1 to 3.5:1, preferably 2.4:1 to 3.3:1 and especially 2.5:1 to 2.8:1. When using magnesium base this corresponds to a weight ratio of $SO_2$ to MgO of from about 3.2:1 to 5.6:1, preferably 3.8:1 to 5.2:1, and especially 4.0:1 to 4.4:1. When using calcium base this corresponds to a weight ratio of $SO_2$ to CaO of from about 2.3:1 to 4.0:1, preferably 2.7:1 to 3.7:1, and especially 2.9:1 to 3.2:1.

The aforestated figures will result in an alkaline earth oxide concentration in the cooking acid of from about 0.4 to 2.2, preferably 0.5 to 1.8, and especially 0.8 to 1.5 percent by weight.

The aforestated figures relating to the composition of the cooking acid are valid for a water content of wood of from about 40 to 60 percent by weight. When deviating from the stated range of water content the composition of the cooking acid feed can be varied so that the concentration of the cooking acid would not be too low if the water content of the wood is too high and vice versa.

The completion of the first step is followed by the feed of liquid $SO_2$ to increase the total $SO_2$ content of the cooking acid to a value of from about 6 to 10 percent by weight, preferably 6 to 8 percent by weight, and especially 6.5 to 7 percent by weight of $SO_2$. A total $SO_2$ content of about 7 percent by weight is most preferred. The temperature at the feed of the liquid $SO_2$ is not critical. Preferably the feed of the liquid $SO_2$ is effected at a temperature of from about 50° to 110° C., in particular 60° to 90° C., a temperature of about 75° C. being especially preferred.

Means for liquefying $SO_2$ are known in principle. An advantage resides in the fact that a content of water in $SO_2$ will have no deteriorating influence so that no special care is to be taken in this respect.

The place at which the liquid $SO_2$ is fed into the digester is not critical provided the aforesaid conditions relating to the $SO_2$ concentration is met. Preferably the feed (as pressure feed) is effected via the circulating line of the digester serving for circulating and, optionally, the heating of the cooking acid.

The second step of the process (digestion) is effected at a temperature of above 110° C., preferably 110° to 180° C., in particular 120° to 170° C., a temperature ranging from 130° to 150° C. being especially preferred. The second step requires about 1.5 to 5 hours. After completion of digestion the digester is relieved by blowing off the vapor phase. $SO_2$ contained in the off gas is recovered as liquid $SO_2$. Means required for this are known to the expert.

Working up of the obtained pulp to chemical cellulose is effected in a manner known per se. The same applies for optional bleaching and other refining steps. Methods which can be used are described in the section "Zellstoff" in "Ullmann's Encyklopadie der technischen Chemie," volume 18 (1967) 751–792, in particular 778–784, and the literature cited therein which disclosure is incorporated herein by reference.

The spent cooking acid is preferably introduced into an apparatus for removing $SO_2$ gases to recover liquid $SO_2$.

As basic components of the cooking acid in the process of the invention calcium or magnesium are suitable. The preparation of the cooking acids using magnesium base and calcium base, respectively, is known to one skilled in the art. When using magnesium bisulfite the magnesium oxide obtained at the burning of the spent liquor can be reused whereas when using calcium bisulfite the preparation of the cooking acid is generally carried out from lime stone ($CaCO_3$) and $SO_2$. Processes which can be used are described in the section "Zellstoff," ibid., in particular 761–764 and the literature cited therein which disclosure is incorporated herein by reference.

When carrying out the process of the invention in practice a part of the cooking acid is withdrawn from the digester before feeding the liquid $SO_2$ to provide space for the pressure build up at temperatures of above 110° C. in the second step (in the second step the pressure inside the digester is normally between 5 and 10 kg/cm$^2$ gauge). When using a digester of 225 m$^3$ from about e.g. 20 to 50 m$^3$, preferably about 30 m$^3$ cooking acid are withdrawn from the digester before feeding the liquid $SO_2$.

When carrying out the inventive process in practice it is necessary before starting with the first step to take care for a good impregnation of the chips with cooking acid. One skilled in the art is well aware of the methods which can be used for this purpose. To achieve a better impregnation shock pressure which is repeated several times, high hydrostatical pressure, treatment with steam or evacuating can be used. Hereby air is removed from the wood pores and the cold feed cooking acid is quickly absorbed by the chips.

The impregnating step is followed by the first step under the above stated conditions. The first step inter alia causes a completion of the impregnation.

In a preferred embodiment of the process of the invention the digester is filled with chips and cooking acid followed by a triple cold pressure impregnation at a pressure of about 4 kg/cm$^2$ gauge. Then the digester content is heated for about 75° C. at a time of from 30 to 40 minutes. After having withdrawn from the digester 20 to 30 m$^3$ cooking acid the $SO_2$ content of the cooking acid is increased to about 7 percent by weight by feeding liquid $SO_2$. Then the reaction is completed at a temperature of from 130° to 150° C. Working up is carried out in a manner known per se.

The process of the invention is preferably carried out batchwise, however, it can also be carried out continuously.

In a further preferred embodiment of the present invention the chips are treated for a time of from 15 to 90 minutes, preferably 30 to 60 minutes, with a reaction liquid of a calculated composition of from 0.5 to 1.5 percent of an alkaline earth oxide and from 3 to 8 percent of sulfur dioxide, preferably 4 to 6 percent sulfur dioxide, at a temperature of from 50° to 90° C. until the pH has decreased to 2.0 to 4.5 depending on the starting pH, followed by withdrawing an amount of the digestion liquid corresponding to at least the amount of water contained in the wood introduced into the digester together with the chips, feeding sulfur dioxide into the digester at a temperature of from 50° to 110° C. to obtain a pH in the liquid of from 2 to 4.5 and completing the digestion within a time of from 1 to 4 hours in a manner known per se by heating at a temperature of from 130° to 150° C.

I have found the process of the invention leading to chemical cellulose qualities characterized by a low lignin content, and a comparatively higher yield. Thus, the reaction conditions adapted to the single reaction steps enable to selectively remove the lignin and simultaneously avoiding hydrolysis or other degradation of cellulose to hemicelluloses.

In addition to the aforestated advantages the process of the invention provides the further advantage that the amount of $SO_2$ required for the digestion is essentially decreased, i.e. in an amount of 15 percent. This is a remarkable effect in a process carried out in technical scale.

A further advantage resides in the fact that the desired effect is not only achieved with a lower consumption of chemicals compared to the known processes but also with cheaper bases which cause, moreover, less environmental pollution. For example it is a known fact that in the recovering of sulfur or bases the absolute recovering degree depends on the concentration of the specific substances. When a comparatively lower amount of sulfur and base is required to achieve a certain technical effect, as in the present process, this results in a potential less environmental pollution.

A further advantage when carrying out the process of the invention in practice resides in that the installation can be simplified.

Figure 2:
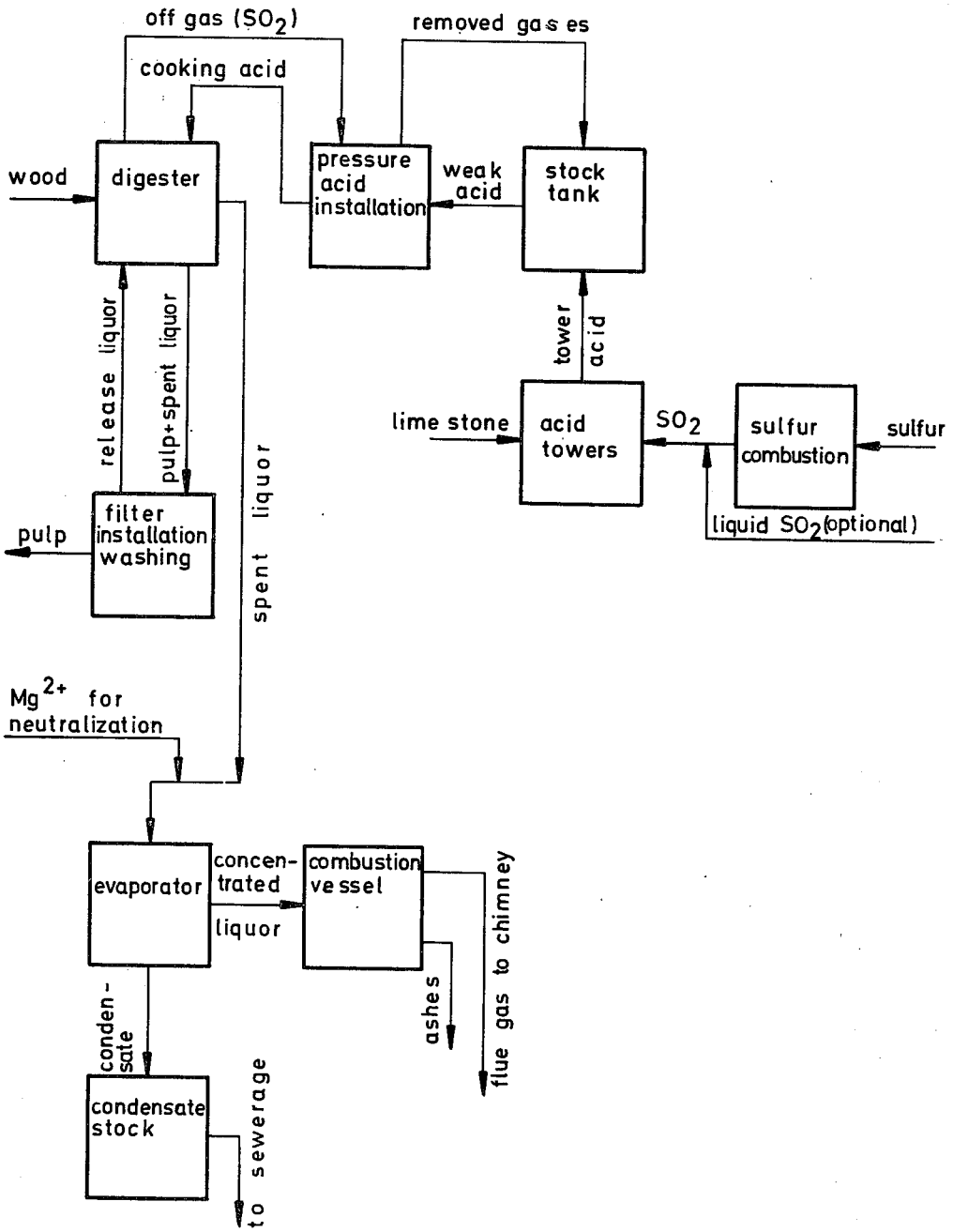
FIG. 2 is a schematic diagram illustrating the known process using calcium as basic component.

FIGS. 1 and 2 relate to schematic diagrams illustrating prior art processes using magnesium and calcium, respectively, as base. In the process using magnesium base (FIG. 1) the digester 1 is filled with chips A and with finished cooking acid B. For gassing with sulfur dioxide at the beginning of the cook and for degassing at the end of the cook sulfur dioxide is passed over the line leading from digester 1 to pressure acid installation 2. After completion of the digestion the pulp C is introduced into filter installation 3, the release liquor D being used for rinsing of digester 1. Spent liquor E is passed over to evaporator 4. Any loss of digestion chemicals is replenished before evaporator 4 by suitable additives F. The concentrated liquor G obtained is fed to combustion vessel 5 and condensate H is fed to stock tank 6'. Ashes J are reconditioned in recovering installation 6, optionally together with fresh magnesium hydroxide K from make up installation 7, and stored in stock tank 8. Loss of sulfur is replenished by burning sulfur L to sulfur dioxide M which is added to weak acid N in reinforcing tower 10 to provide cooking acid O in stock tank 11.

When carrying out the known process with calcium as base according to FIG. 2 regeneration installation is omitted because the problem of recovering sulfur has not been satisfactorily solved in this process. The other steps correspond to the aforestated system.

Figure 3:
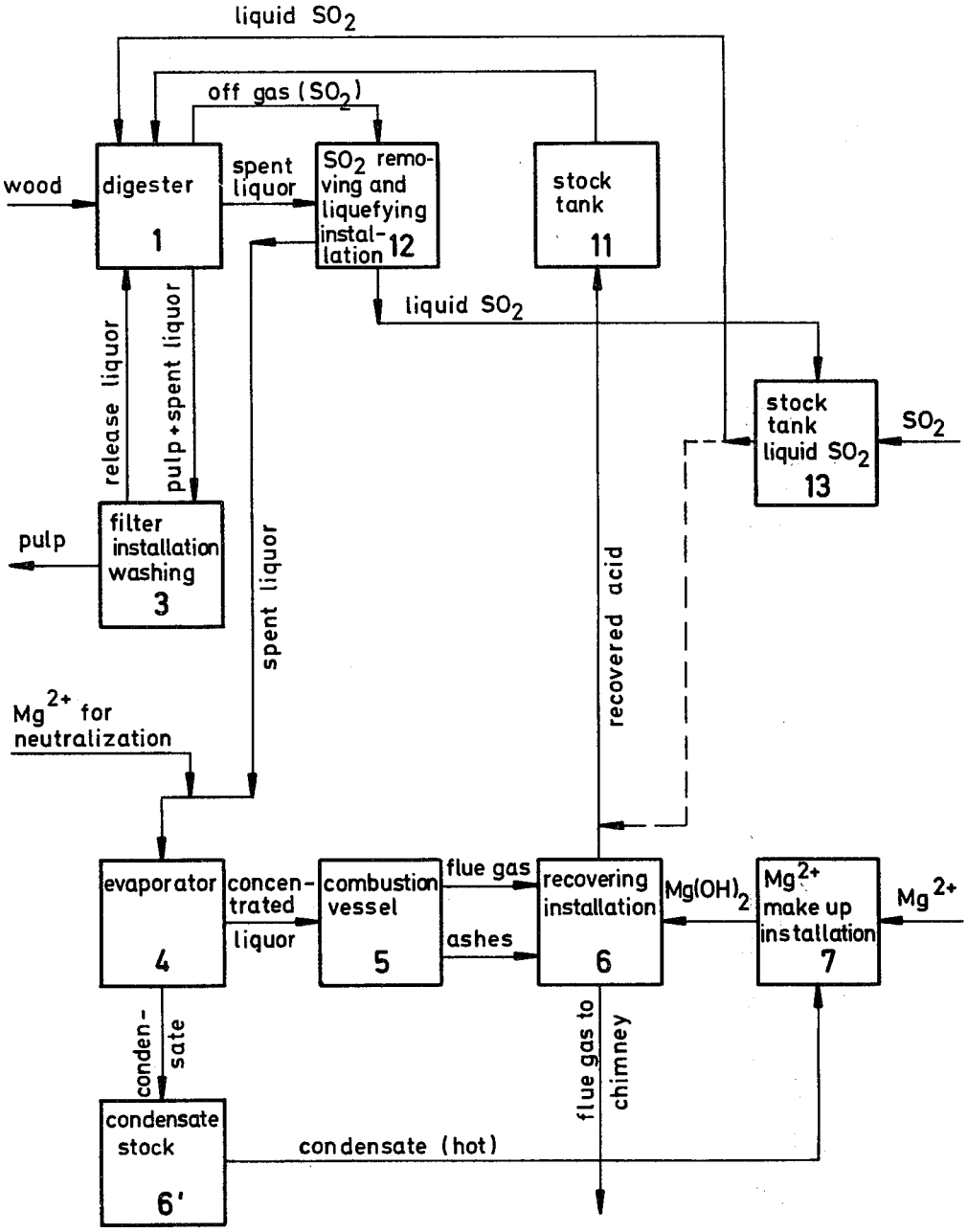
FIG. 3 is a schematic diagram illustrating the inventive process using magnesium as basic component and liquid sulfur dioxide.
Figure 4:
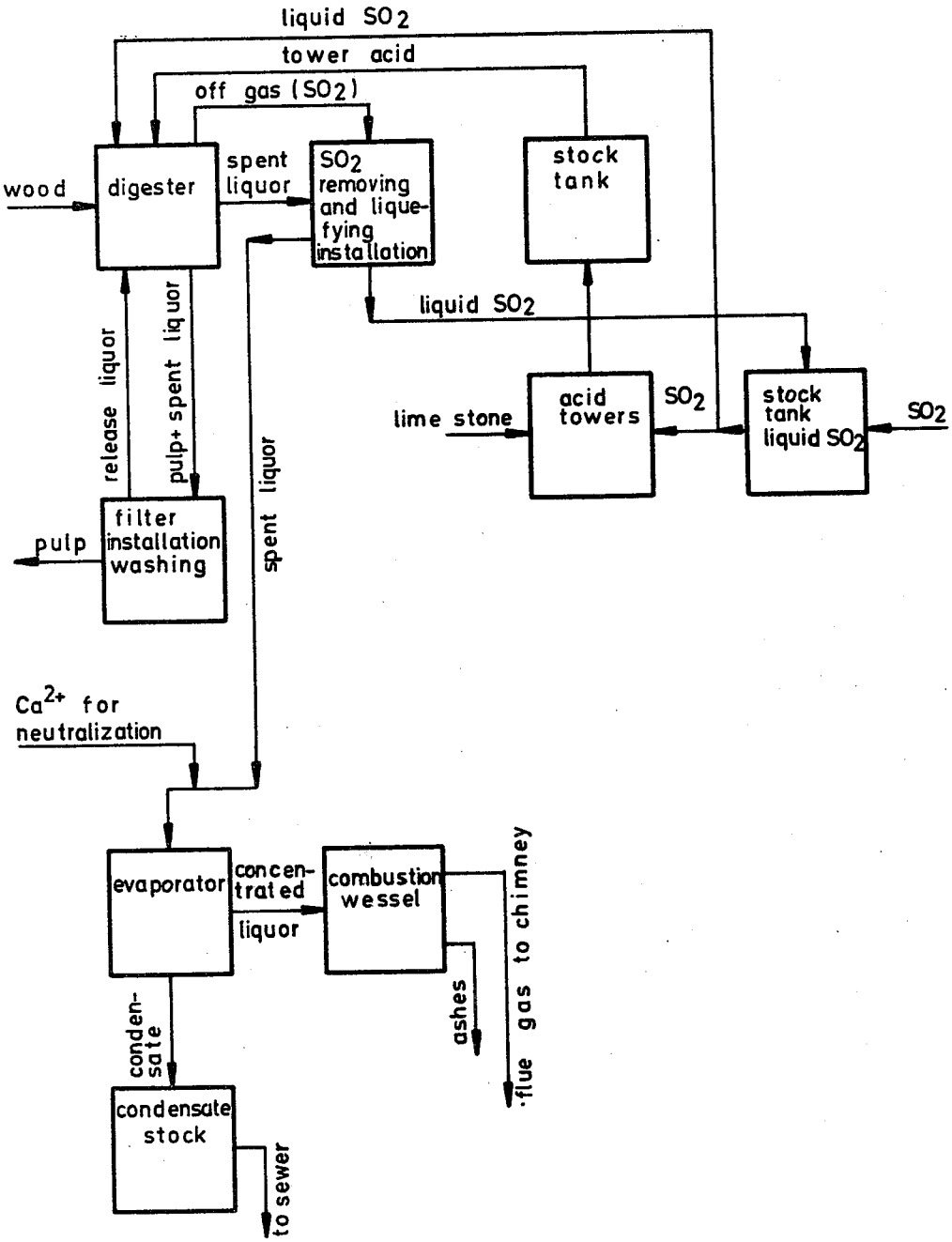
FIG. 4 is a schematic diagram illustrating the inventive process using calcium as basic component and liquid sulfur dioxide.

Compared to the known process (FIGS. 1 and 2) the pressure acid installation 2 can be omitted in the process of the invention (FIGS. 3 and 4) because a weakly concentrated reaction liquid in connection with gaseous sulfur dioxide is sufficient for digestion. It is convenient to use liquid sulfur dioxide which is evaporated before use. Liquid sulfur dioxide can be fed to digester 1 directly from stock tank 13. After fulfilment of the chemical object excess of sulfur dioxide is withdrawn from digester 1 and fed via sulfur dioxide liquefying installation 12 to stock tank 13. Thus, as a further advantage, a closed sulfur dioxide circuit results, and such a system can be much more easily controlled from a environmental pollution point of view than a liquid system.

Since further contents of the schematic diagrams are self-explanatory it is not necessary to describe further details.

The chemical cellulose or pulp obtained according to the process of the invention is advantageous over the products obtained according to conventional processes.

In tables 1 and 2 a beech pulp and a spruce pulp obtained according to prior art is compared to a beech pulp and spruce pulp, respectively, obtained according to the process of the invention under similar conditions (the production of the inventive pulps is illustrated in examples 1 and 2 set forth hereinafter). At the same lignin content indicated by the JN-value, higher viscosities and higher cellulose gum contents as well as a substantially lower branch amount are obtained. Surprisingly these advantages are accompanied by an increased yield: whereas the prior art process requires 6.19 cubic meters beech wood for the production of 1 ton of pulp the process of the invention requires only 5.76 cubic meters.

The pulp prepared according to the process of the invention is superior over prior art pulp also in the physical properties. The data concerning burst factor and tear propagation energy are remarkably above the prior art data. Moreover, a desired slower milling development is obtained according to the inventive process resulting in a comparatively higher tearing length. The better chemical composition of the pulps prepared according to the process of the invention is also indicated by the consumption of chemicals at the bleaching. Compared to conventionally prepared pulp having a chlorine consumption of 9.26 percent, the chlorine consumption at the bleaching of pulps prepared according to the process of the invention is decreased to 6.28 percent, i.e. about one third. Moreover, the consumption of caustic soda is decreased, i.e. from 4.10 to 2.38 percent.

Furthermore, a remarkable advantage resides in the lower water consumption in pulp bleaching because not only is a smaller amount of chemicals required to achieve a certain bleaching effect but also the amount of for disposing bleaching waste water can be decreased.

Table 1

Characteristical properties of pulps made from beech

| | conventional process | inventive process |
|---|---|---|
| 1. yield ($m^{3a)}$/ton pulp) | 6.19 | 5.76 |
| 2. chemical properties | | |
| JN value[b)] (digestion degree) | 43 | 43 |
| viscosity, unbleached (mp) (1 percent solution in cuoxam) | 1293 | 1792 |
| content of cellulose gum , % | 7.8 | 10.2 |
| JN value[b)] of branches + pulp material | 58 | 50 |
| 3. physical properties | | |
| dewaterability after 30 min milling in a Jokro mill (°SR)[c)] | 57 | 54 |
| relative burst pressure ($kg/cm^2$) | 2.59 | 3.17 |
| tear propagaton energy (cm · g/cm) | 99 | 108 |
| tearing length (m) | 6020 | 5930 |
| strength factor $\left(\frac{\text{tearing length (m)}}{\text{milling degree (° SR)}}\right)$ | 105.6 | 109.8 |
| 4. consumption at bleaching | | |
| chlorine (%) | 9.26 | 6.28 |
| NaOH (%) | 4.10 | 2.38 |

[a)]"Verbrauchsraummeter", used in FRG
[b)]JN = Johnsen-Noll value;
[c)]SR = Schopper-Riegler;

Whereas the aforestated results relate to beech important wood for the production of pulp from leaf wood, similar data are obtained when using spruce as typical member of conifers.

As can be seen from the results contained in table 2 the process of the invention enables one to obtain a whiteness of above 91 percent without deteriorating the mechanical properties or increasing the consumption of bleaching agents. Moreover, the slower milling development is advantageous for the use of the pulp in paper making.

Table 2

Characteristic properties of pulps made from spruce

| | conventional process | inventive process |
|---|---|---|
| 1. yield ($m^{3a)}$/ton of pulp) | 7.25 | 7.16 |
| 2. chemical properties | | |
| JN value[b)] (digestion degree) | 38 | 42 |
| viscosity, unbleached (mp) (1 percent solution in cuoxam) | 1543 | 1944 |
| 3. physical properties | | |
| dewaterability after 30 min. milling in a Jokro mill (° SR)[c)] | 62 | 57 |
| tear propagation energy (cm · g/cm) | 123 | 133 |
| tearing length (m) | 7450 | 6970 |
| strength factor $\left(\frac{\text{tearing length (m)}}{\text{milling degree (° SR)}}\right)$ | 121 | 124 |
| 4. whiteness degree (%) | 89.7 | 91.0 |

[a)], [b)], [c)]foot notes : see table 1

The following examples are given to illustrate the invention in greater detail.

EXAMPLE 1

Digestion of Beech Wood with Calcium as Base 100,464 kg beech wood chips having a water content of 45% are filled into a digester of 225 $m^3$ and treated with steam. Then, 140 $m^3$ of a weak acid are added containing 1.26% of calcium oxide and 5% of sulfur dioxide. Then the temperature is increased from 40° to 75° C. within a period of 25 min. by introducing steam into the digester, and the stated temperature is maintained for a period of 30 min. After that time 30 $m^3$ of digestion liquid are withdrawn from the digester and liquid sulfur dioxide is fed into the digester until a pH (measured at room temperature) of 2 is reached. After completion of this operation steam is introduced into the digester to increase the temperature to 135° to 138° C. The stated temperature is maintained for about 1 hour and then excess of sulfur dioxide is blown off and refed into the acid stock system via the liquefying installation.

The pulp thus obtained has the properties shown in table 1. This pulp is compared to a pulp which has been prepared according to the conventional one step process.

EXAMPLE 2

Digestion of Spruce Wood with Calcium as Base 62,640 kg spruce wood chips having a water content of 40% are filled into a 225 $m^3$ digester while treating with steam. Then, 150 $m^3$ of a digestion liquid containing 1.06% of calcium oxide and 6% of sulfur dioxide are fed into the digester whereupon the temperature is increased from 40° to 50° C. within a period of 10 min. by introducing steam into the digester. The stated temperature is maintained for a period of 15 min. Then, 50 $m^3$ of digestion liquor are withdrawn from the digester and sulfur dioxide is introduced into the digester to adjust the pH to a value of 3. After having checked this value steam is introduced into the digester and the digester content is cooked 2 hours at a temperature of from 140° to 142° C. Working up of the batch is carried out in a similar manner as in example 1.

The pulp thus obtained is tested in respect to essential properties. The obtained values are contained in table 2.

EXAMPLE 3

Digestion of Beech Wood with Magnesium as Base 97,000 kg beech wood chips having a water content of 35% are filled into a 225 $m^3$ digester by using a steam-fed filling apparatus. 140 $m^3$ of a reaction liquid having a calculated composition of 1.2% magnesium oxide and 4% of sulfur dioxide are used for the digestion. The temperature in the digester (40° C.) is increased to 80° C. within a period of 25 min. The stated temperature is maintained for a period of 40 min. After having withdrawn 55 $m^3$ of the reaction liquid from the digester liquid sulfur dioxide is introduced to adjust the pH to 3.5. Then the temperature is increased by introducing steam into the digester to a temperature of 140° to 142° C. which temperature is maintained for a period of 75 min. At this temperature the excess of sulfur dioxide is blown off into the liquefying installation for recycling into the stock system.

EXAMPLE 4

Digestion of Spruce Wood with Magnesium as Base

An amount of 53,690 kg spruce wood chips having a water content of 30% are filled into a 225 $m^3$ digester while treating with steam by using a filling apparatus. First, the chips are treated with a reaction liquid having a calculated content of 0.8% of magnesium oxide and 5% of sulfur dioxide. The starting temperature is 50° C. This temperature is increased to 60° C. which temperature is maintained for a period of 12 min. Then 70 $m^3$ liquid is withdrawn from the digester which is then closed and fed with sulfur dioxide until a pH of 2 is reached. Afterwards the temperature is increased to 136° to 140° C. by introducing steam into the digester and this temperature is maintained for a period of 90 min. Working up of the batch is carried out in a similar manner as in the foregoing examples.

The present process can also be applied in principle on other conifers and leaf wood or one year plants. In doing so the temperature can also be essentially increased.

The invention is further illustrated by the following examples which are especially preferred embodiments of the invention.

EXAMPLE 5

Digestion of Beech Wood with Calcium as Base 100,500 kg beech wood chips having a water content of 45 percent by weight are filled into a 225 $m^3$ digester while being treated with steam. Then 125 $m^3$ cooking acid are added containing 1.26 percent by weight of calcium oxide and 4 percent by weight of sulfur dioxide. By introducing steam into the digester the temperature is increased within 25 min. from 40° to 75° C. This temperature is maintained for a period of 30 min. After having withdrawn 30 $m^3$ cooking acid from the digester liquid $SO_2$ is fed into the digester in such an amount that the $SO_2$ content of the remaining cooking acid is 7 percent by weight. Afterwards the temperature is increased to 135° to 138° C. At this temperature the digestion (cooking) is completed (1 hour). Next the excess of sulfur dioxide is blown off and refed into the acid stock system via the liquefying installation.

Working up of the reaction product to obtain pulp is carried out in a usual manner by washing in the digester, stepwise washing in the washing installation, etc.

EXAMPLE 6

Digestion of Spruce Wood with Calcium as Base 62,500 kg spruce wood chips having a water content of 40% are filled into a 225 $m^3$ digester while treating with steam. Then 130 $m^3$ of cooking acid are added containing 1.06 percent by weight of calcium oxide and 3.8 percent by weight of sulfur dioxide. By introducing steam the temperature is increased from 40° to 75° C. within a period of 10 min. This temperature is maintained for a period of 30 min. After having withdrawn 50 $m^3$ cooking acid from the digester liquid sulfur dioxide is fed into the digester in such an amount that the $SO_2$ content of the remaining cooking acid is 7 percent by weight. Next the digester content is cooked at a temperature of from 140° to 142° C. for 2 hours. Working up of the reaction product is carried out in a manner similar to example 5.

EXAMPLE 7

Digestion of Beech Wood with Magnesium as Base 97,000 kg beech wood chips having a water content of 40% are filled into a 225 $m^3$ digester by using a steam-fed filling apparatus. Next 130 $m^3$ cooking acid are added containing 1.2% of magnesium oxide and 4 percent by weight of sulfur dioxide. By introducing steam the temperature in the digester is increased from 40° to 75° C. within a period of 25 min. This temperature is maintained for a period of 40 min. After having withdrawn 35 $m^3$ cooking acid from the digester liquid sulfur dioxide is fed into the digester in such an amount that the $SO_2$ concentration in the remaining cooking acid is 7%. Then steam is fed into the digester to increase the temperature to 140° to 142° C. This temperature is maintained 1.25 hours. Working up of the reaction product is carried out in a manner similar to example 5.

EXAMPLE 8

Digestion of Spruce Wood with Magnesium as Base 53,500 kg spruce wood chips having a water content of 40% are filled into a 225 $m^3$ digester while treating with steam by using a filling apparatus. Then 120 $m^3$ cooking acid are added containing 0.8 percent by weight of magnesium oxide and 4.0 percent by weight of sulfur dioxide. Next the temperature is increased to 75° C. and this temperature is maintained for a period of 30 min. After having withdrawn 30 $m^3$ cooking acid from the digester liquid $SO_2$ is fed into the digester in such an amount that the $SO_2$ content of the remaining cooking acid is about 7 percent by weight. Finally the temperature is increased to 136° to 140° C. and maintained at this value for a period of 1.5 hours. Working up of the reaction product is carried out in a manner similar to example 5.

While the invention has been described in detail and with reference to specific embodiments thereof, it will be apparent to one skilled in the art that various changes and modifications can be made therein without departing from the spirit and scope thereof.

What is claimed is:

1. A process for preparing chemical cellulose which comprises:

(a) treating wood in the form of chips in a cooking zone for a period of from about 15 to 90 minutes with a cooking acid of a calculated concentration of below 5 percent by weight and at least 2.5 percent by weight $SO_2$ and a mole ratio of $SO_2$ to MgO or CaO of from about 2:1 to 3.5:1 at a temperature of from about 45° to 90° C., then;

(b) feeding liquid $SO_2$ into said cooking zone until the total $SO_2$ content of the cooking acid is from about 6 to 10 percent by weight;

(c) digesting the treated chips by cooking at a temperature of above 110° C. to obtain a pulp; and (d) recovering the chemical cellulose from said pulp.

2. The process of claim 1, in which step (a) is carried out within a period of from 30 to 60 minutes.

3. The process of claim 1, in which the temperature in step (a) is from 55° to 80° C.

4. The process of claim 1, in which the temperature in step (a) is from 70° to 80° C.

5. The process of claim 1, in which the temperature in step (a) is about 75° C.

6. The process of claim 1, in which the cooking acid in step (a) has a $SO_2$ concentration of from 2.9 to 4.9 percent by weight.

7. The process of claim 1, in which the cooking acid in step (a) has a $SO_2$ concentration of about 4.0 percent by weight.

8. The process of claim 1 in which the cooking acid in step (a) has a mole ratio of $SO_2$ to MgO or CaO of from 2.4:1 to 3.3:1.

9. The process of claim 1, in which the cooking acid in step (a) has a mole ratio of $SO_2$ to MgO or CaO of from 2.5:1 to 2.8:1.

10. The process of claim 1, in which the cooking acid in step (b) has a $SO_2$ concentration of from 6 to 8 percent by weight.

11. The process of claim 1, in which the cooking acid in step (b) has a $SO_2$ concentration of from 6.5 to 7 percent by weight.

12. The process of claim 1, in which the cooking acid in step (b) has a $SO_2$ concentration of about 7 percent by weight.

13. The process of claim 1, in which the liquid $SO_2$ is fed into said cooking zone maintained at a temperature of from 60° to 90° C.

14. The process of claim 1, in which the liquid $SO_2$ is fed into said cooking zone maintained at a temperature of about 75° C.

15. The process of claim 1, in which the temperature in step (b) is from 120° to 170° C.

16. The process of claim 1, in which the temperature in step (b) is from 130° to 150° C.

17. The process of claim 1 in which after completion of step (b) gaseous $SO_2$ is blown off from said cooking zone by pressure release, liquefied in a liquifying installation and recycled to the process.

18. The process of claim 1, in which after completion of step (b), the spent cooking acid in said cooking zone is fed to an apparatus for removing dissolved gases to recover $SO_2$.

19. The process of claim 1, in which the chips in said cooking zone, after the addition of the cooking acid and before the treatment of step (a), are subjected to multiple cold pressure impregnations.

* * * * *

UNITED STATES PATENT OFFICE
CERTIFICATE OF CORRECTION

Patent No. 4,141,787 Dated February 27, 1979

Inventor(s) Reinhold Schadler

It is certified that error appears in the above-identified patent and that said Letters Patent are hereby corrected as shown below:

Column 1, line 22: Cancel "of".

line 58: Cancel "at the".

Column 4, line 14: "at" should be --for--.

Column 7, line 41: After "value" insert a comma.

Signed and Sealed this

*Twenty-fourth* Day of *July 1979*

[SEAL]

*Attest:*

*Attesting Officer*

LUTRELLE F. PARKER

*Acting Commissioner of Patents and Trademarks*